US006974191B2

(12) United States Patent
Serhan

(10) Patent No.: US 6,974,191 B2
(45) Date of Patent: Dec. 13, 2005

(54) SHOWER CHAIR WITH INTERLOCKING ARMS

(75) Inventor: Michael Serhan, Arcadia, CA (US)

(73) Assignee: Medical Depot, Inc., Port Washington, NY (US)

( * ) Notice: Subject to any disclaimer, the term of this patent is extended or adjusted under 35 U.S.C. 154(b) by 40 days.

(21) Appl. No.: 10/772,614

(22) Filed: Feb. 4, 2004

(65) Prior Publication Data

US 2005/0179304 A1 Aug. 18, 2005

(51) Int. Cl.[7] ..... A47C 7/00

(52) U.S. Cl. ..... 297/440.24; 297/183.9; 297/440.15; 297/411.28; 297/452.2; 4/578.1

(58) Field of Search ..... 297/440.1, 440.15, 297/440.16, 440.24, 183.9, 183.4, 411.28, 297/411.29, 411.44, 411.25, 440.14, 452.2; 4/578.1, 576.1

(56) References Cited

U.S. PATENT DOCUMENTS 5,887,297 A * 3/1999 Sutor ..... 4/578.1
6,039,403 A * 3/2000 Hargroder ..... 297/440.24
6,105,183 A * 8/2000 Bly ..... 4/578.1
6,122,776 A * 9/2000 Cheng ..... 297/440.24
2003/0102700 A1 6/2003 Lin

* cited by examiner

*Primary Examiner*—Anthony D. Barfield
(74) *Attorney, Agent, or Firm*—Wolff and Samson PC

(57) ABSTRACT

A bath chair having elongated slots on opposite sides, legs secured to the seat, and a backrest mounted on two opposed L-shaped backrest support tubes, is provided with a pair of handrails secured to the seat by the horizontal segments of the backrest support tubes. Pairs of connecting tubes are mounted on opposite sides of the bottom face of the seat, each connecting tube having a cylindrical opening sized and disposed to receive respective horizontal segments of the backrest support tubes. The handrails are inserted through respective seat slots, each carrying a cylindrical member at its end disposed between and aligned with opposed connecting tubes. The horizontal segments of the backrest support tubes are inserted through the connecting tubes and the handrail cylindrical members therebetween so as to secure the handrail to the seat. Each handrail is formed with a sigmoidal segment between a vertically directed upper segment and a horizontally directed lower segment, to facilitate insertion through the respective elongated slot. In particular embodiments, the handrails are each formed of opposed tubular members and have grips that are either fixed or telescopically mounted with spring-loaded snap buttons and corresponding position holes to adjust their height.

20 Claims, 4 Drawing Sheets

SHOWER CHAIR WITH INTERLOCKING ARMS

FIELD OF THE INVENTION

The present invention relates to a bath chair having arms and a backrest that interlock so as to be securely fastened to the chair without the need to fasten them directly to the chair seat.

BACKGROUND OF THE INVENTION

A conventional bath chair, sometimes called a combination type bath chair, generally has a seat with each side formed with an elongated slot, thereby forming a handgrip, two L-shaped backrest support tubes on which the backrest is mounted, and foot tubes. The backrest support tubes and foot tubes can be formed of telescoping members with snap buttons and corresponding position holes to adjust the height of the seat and position of the backrest. In U.S. Patent Application Publication No. 2003/0102700 of Fang-Sheng Lin, entitled "Combination Type Bath Chair", a pair of L-shaped handrails are inserted through each elongated slot and secured with nuts and bolts to the bottom face of the chair seat. Lin's handrails are formed integrally, and therefore cannot be easily removed when disassembling the chair for storage or shipment, or in the event that a user prefers the handgrips of the usual bath chair, namely those formed only by the elongated slots.

SUMMARY OF THE INVENTION

The present invention overcomes the foregoing drawbacks by providing a pair of handrails secured to the seat only by the horizontal segments of the backrest support tubes. More particularly, a bath chair is provided having elongated slots on opposite sides, legs secured to the seat, and a backrest mounted on two opposed L-shaped backrest support tubes. A pair of handrails is secured to the seat by the horizontal segments of the backrest support tubes. Pairs of connecting tubes are mounted on opposite sides of the bottom face of the seat, each connecting tube having a cylindrical opening sized and disposed to receive respective horizontal segments of the backrest support tubes. The handrails are inserted through respective seat slots, each carrying a cylindrical member at its end disposed between and aligned with opposed connecting tubes. The horizontal segments of the backrest support tubes are inserted through the connecting tubes and the handrail cylindrical members therebetween so as to secure the handrail to the seat. Each handrail is formed with a sigmoidal segment between a vertically directed upper segment and a horizontally directed lower segment, to facilitate insertion through the respective elongated slot. In particular embodiments, the handrails are each formed of opposed tubular members and have grips that are either fixed or telescopically mounted with spring-loaded snap buttons and corresponding position holes to adjust their height.

DETAILED DESCRIPTION OF THE INVENTION

Figure 1:
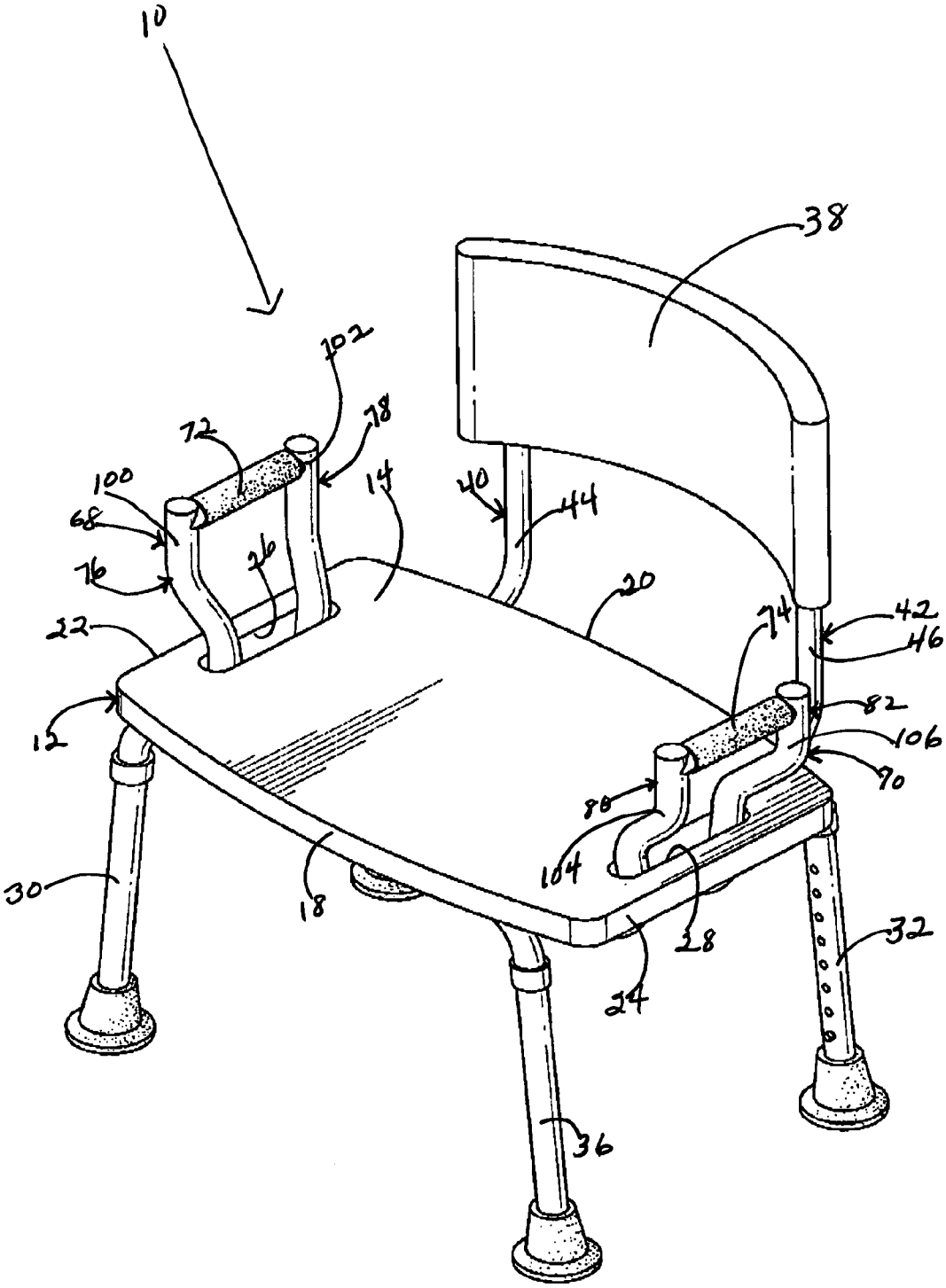
FIG. 1 is a perspective view of a bath chair in accordance with a first embodiment of the present invention.
Figure 2:
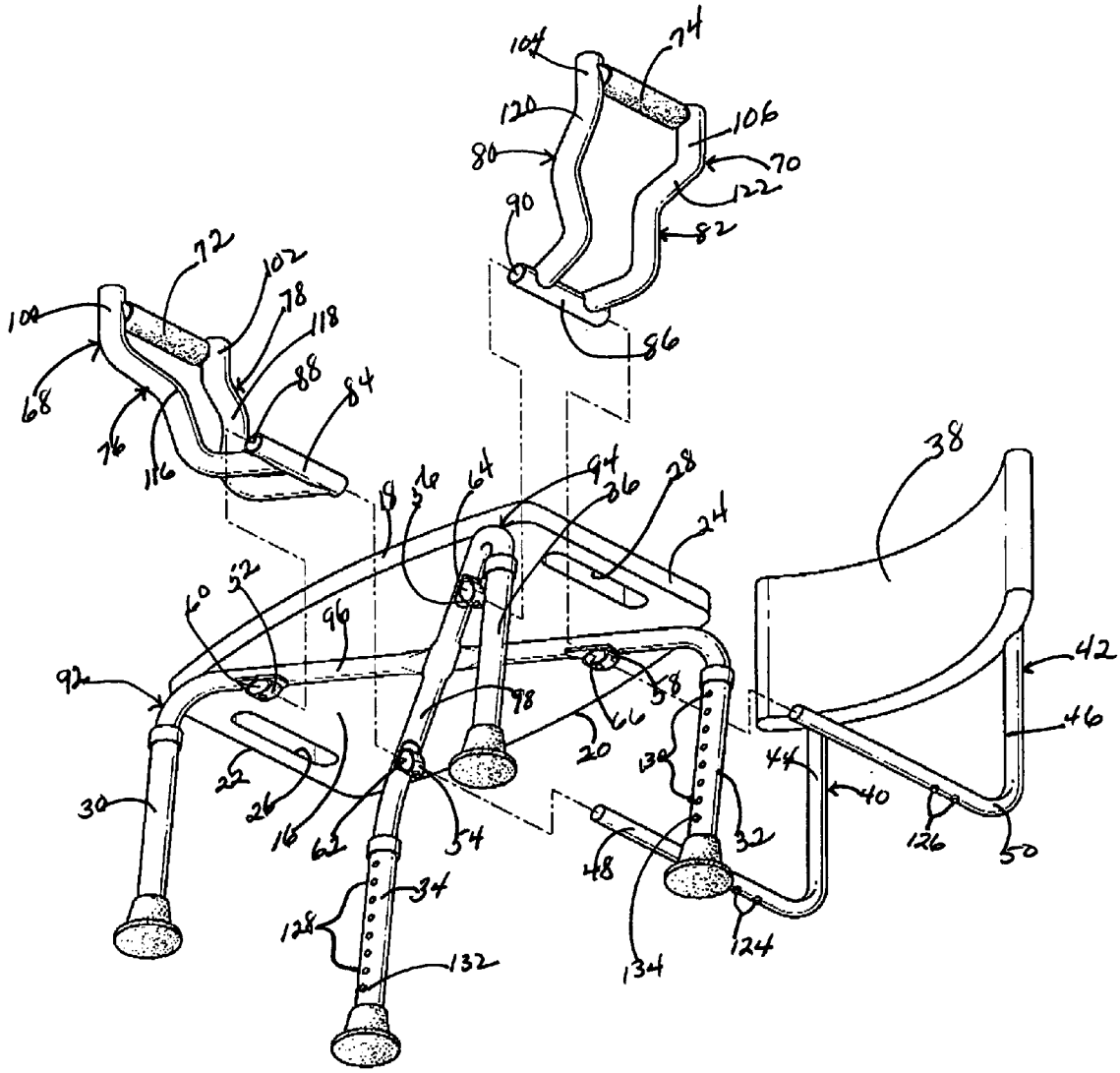
FIG. 2 is an exploded perspective bottom view of the bath chair of FIG. 1.
Figure 3:
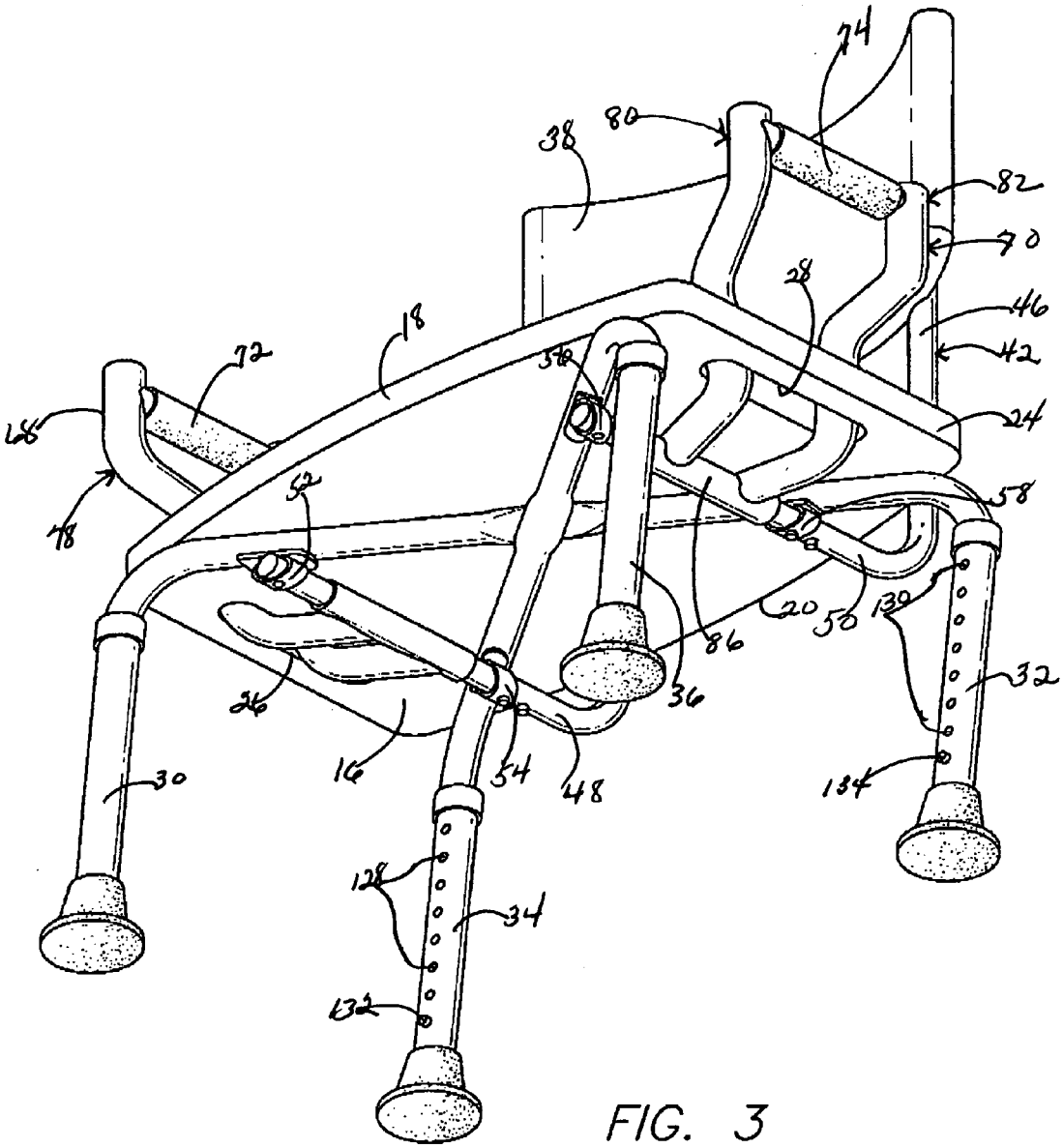
FIG. 3 is a perspective bottom view of the assembled bath chair of FIG. 1.

Referring to FIGS. 1, 2 and 3, a first embodiment of a bath chair 10 of this invention includes a seat 12 having top and bottom faces 14 and 16, a front 18 and rear 20 and two sides 22 and 24, each side formed with an elongated slot, respectively 26 and 28. Legs 30, 32, 34, and 36 are secured to the seat 12. A backrest 38 is mounted on a pair of opposed L-shaped backrest support tubes 40 and 42, each having a vertically directed segment, respectively 44 and 46, and a horizontal segment, respectively 48 and 50. The backrest 38 is mounted across the two vertically directed segments 44 and 46. In a manner that will be described below in more detail, pairs of connecting tubes 52, 54 and 56, 58 are mounted on opposite sides of the bottom face 16 of the seat 12. Each connecting tube 52, 54, 56, and 58 has a cylindrical opening, respectively 60, 62, 64, and 66, sized and disposed so that cylindrical openings 60,62 and 64,66 of each pair are aligned with and spaced from each other whereby each pair can receive respective horizontal segments 48 and 50 of the backrest support tubes 40 and 42.

A pair of handrails 68 and 70 are provided, each formed with a hand grip 72 and 74 and an insertion member formed of a pair of opposed tubular members, respectively 76,78 and 80,82, having their upper ends fixed to respective hand grips 72 and 74, and having their lower ends connected to respective cylindrical members 84 and 86. The cylindrical members 84 and 86 are of a length equal to or shorter than the distance between opposed connecting tubes 52, 54 and 56, 58 and have openings 88 and 90 sized to receive horizontal segments 48 and 50 of the backrest support tubes 40 and 42.

Referring more particularly to FIG. 2, the legs 30, 32, 34, and 36 are formed from two inverted U-shaped foot tubes 92 and 94 having horizontal segments 94 and 98 between opposed vertically directed legs 30, 32 and 34, and 36. The horizontal segments 94 and 96 are mounted crosswise to the bottom seat face 16 whereby vertically directed legs 30 and 32 of one foot tube 92 are disposed opposite respective vertically directed legs 34 and 36 of the other foot tube 94 on each side of the seat 12. The opposed pairs of connecting tubes 52, 54 and 56, 58 are secured to the bottom of respective horizontal segments 94 and 96 so as to be spaced inwardly from the elongated seat slots 26 and 28. Each leg 30, 32, 34, and 36 is formed with telescoping tubes with a plurality of position holes, such as at 128 and 130, on the outer tubes and spring-loaded snap buttons such as at 132 and 134, on the inner tubes for snap insertion into the position holes 128 and 130 to secure the legs 30, 32, 34, and 36 at a desired height.

Each pair of opposed tubular members 76,78 and 80,82 of the respective handrails 68 and 70 are inserted through the respective elongated slots 26 and 28 so that, in accordance with this invention, the cylindrical members 84 and 86 are disposed between and aligned with the opposed connecting tubes 52, 54 and 56, 58. The handrails 68 and 70 are formed with sigmoidal segments between the vertically directed upper segments 100, 102 and 104,106 and horizontally directed lower segments 108, 110 and 112, 114. Sigmoidal segments 116, 118 and 120, 122 are formed between the vertically directed upper segments 100, 102, 104, and 106 and horizontally directed lower segments 108,110, 112, and 114 to facilitate insertion through the elongated slots 26 and 28.

The horizontal segments 48 and 50 of the backrest support tubes 40 and 42 each have a plurality of spring loaded snap buttons, respectively 124 and 126. Proximal connecting tubes 54 and 58 have position holes 124 and 126 for the snap buttons to secure the backrest 38 at a selected desired distance from the rear of the seat. The position holes could alternatively or additionally be located on the distal connecting tubes 52 and 56 and/or on the cylindrical members 84 and 86.

It will be seen that in accordance with this invention, the handrails 68 and 70 are very securely mounted on the bath chair 10 through the slots 26 and 28 without the need for the use of nuts or bolts. Upon removal of the backrest support tubes 40 and 42, the handrails 68 and 70 are released and can be readily removed.

Figure 4:
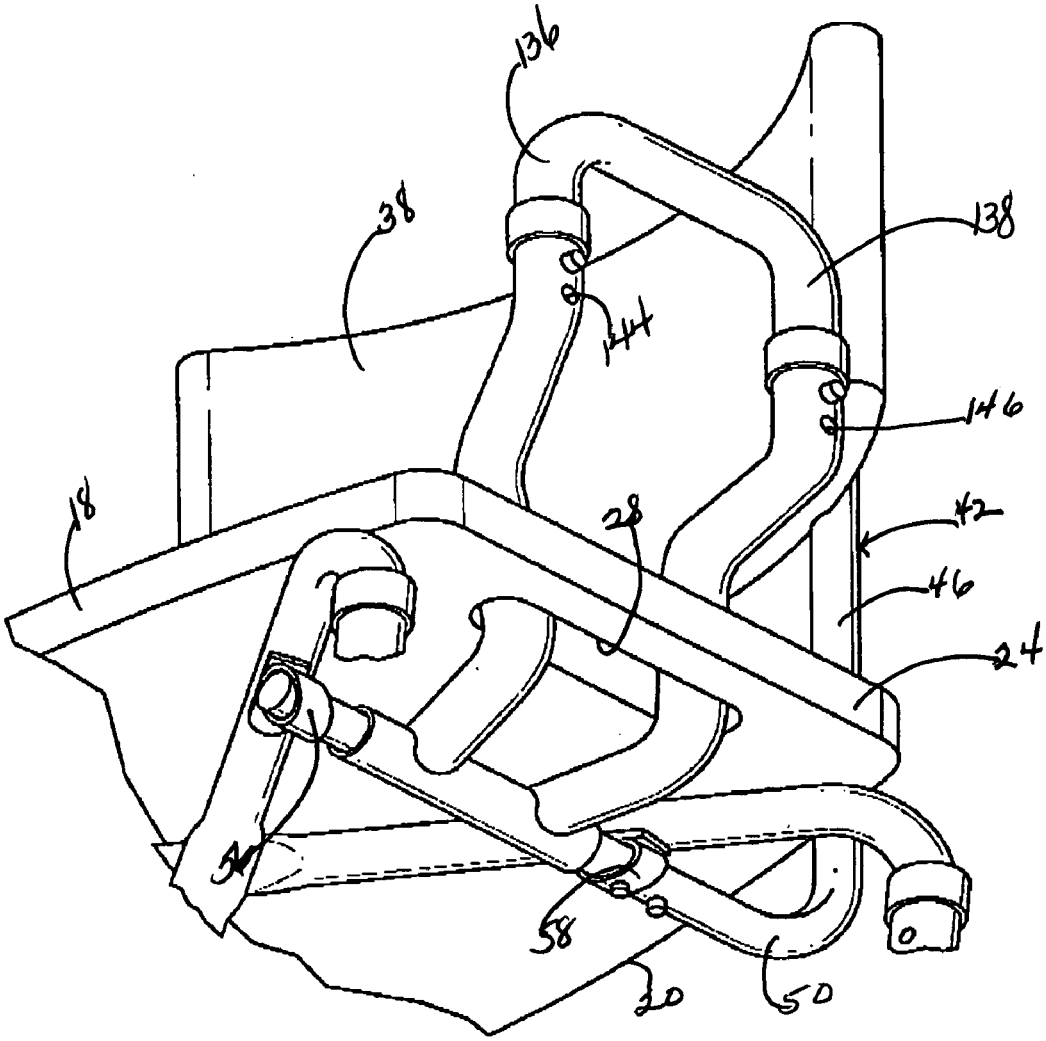
FIG. 4 is a perspective bottom view of one side of a second embodiment of the bath.

Referring to FIG. 4, and the right hand side of the bath chair (facing the backrest 38), in another embodiment of the invention, the tubular structure of each handrail is formed with upper vertically directed segments, such as at 136 and 138, in telescopic relation with the handrail's tubular members, such as at 140 and 142. The tubular members 140 and 142 each have a plurality of position holes 144 and 146 and the upper vertically directed segments 136 and 138 are fitted with spring-loaded snap buttons 148 and 150 for snap insertion into respective position holes 144 and 146 to secure the handrail at a desired height. Alternatively, the telescopic relationship can be reversed, the snap buttons being carried by the inner tube members. In all other respects the handrails of this embodiment are constructed in like manner to the handrails of the first described embodiment.

What is claimed is:

1. A bath chair, comprising:

a seat having top and bottom faces, a front and a rear and two sides, each side formed with an elongated slot;

legs secured to the seat;

a backrest;

two opposed L-shaped backrest support tubes, each having a vertically directed segment and a horizontal segment, the backrest being mounted across the two vertically directed segments;

pairs of connecting tubes mounted on opposite sides of the bottom face of the seat, each connecting tube having a cylindrical opening sized and disposed so that cylindrical openings of each pair are aligned with and spaced from each other whereby each pair can receive respective horizontal segments of the backrest support tubes; and a pair of handrails, each formed with a hand grip, an insertion member having an upper end connected to the hand grip and a lower end connected to a cylindrical member of a length equal to or shorter than the distance between opposed connecting tubes of each pair of connecting tubes, the cylindrical member having an opening sized to receive a horizontal segment of one of the backrest support tubes, the insertion member of the handrail being inserted through one of the elongated slots so that the cylindrical member is disposed between and aligned with opposed connecting tubes, the horizontal segment of one of the backrest support tubes being inserted through the opposed connecting tubes and the cylindrical member therebetween whereby to secure the handrail to the seat.

2. The bath chair of claim 1 in which the connecting tubes are mounted spaced from the elongated seat slots.

3. The bath chair of claim 2 in which the insertion member of each handrail has a vertically directed upper segment connected at its upper end to the hand grip, and a horizontally directed lower segment secured to the cylindrical member to align the cylindrical member with respective connecting tubes when fully inserted through the elongated slots.

4. The bath chair of claim 3 in which each handrail is formed with a sigmoidal segment between each vertically directed upper segment and horizontally directed lower segment to facilitate insertion through the respective elongated slot.

5. The bath chair of claim 1 in which each handrail insertion member is formed of a pair of opposed tubular members.

6. The bath chair of claim 5 in which the connecting tubes are mounted spaced from the elongated seat slots, the tubular members of each handrail having vertically directed upper tubular segments connected at their upper ends to the hand grip, and horizontally directed lower tubular segments secured to the cylindrical member to align the cylindrical member with respective connecting tubes when fully inserted through the elongated slots.

7. The bath chair of claim 6 in which each handrail is formed with a sigmoidal segment between each vertically directed upper segment and horizontally directed lower segment to facilitate insertion through the respective elongated slot.

8. The bath chair of claim 5 in which the hand grip of each handrail is fixed to the handrail's opposed tubular members.

9. The bath chair of claim 6 in which the hand grip is formed with vertically directed tubes in telescopic relation with the handrail's tubular members, the handrail having a plurality of position holes on the outer tube and a spring-loaded snap button on the inner tube for snap insertion into a position hole to secure the handrail at a desired height.

10. The bath chair of claim 1 in which the horizontal segment of each backrest support tube has at least one spring loaded snap button, at least one of the respective connecting tubes and handrail cylindrical member having a position hole for the snap button to secure the backrest at a desired distance from the rear of the seat.

11. The bath chair of claim 10 in which the position hole is on one of the respective connecting tubes.

12. The bath chair of claim 10 in which the horizontal segment of each backrest support tube has a plurality of spring loaded snap buttons along its length to secure the backrest at one of a plurality of distances from the rear of the seat.

13. The bath chair of claim 1 in which the legs are formed from two inverted U-shaped foot tubes, each having a horizontal segment between opposed vertically directed legs, the horizontal segments of the foot tubes being mounted crosswise to the bottom seat face whereby vertically directed legs of one foot tube are disposed opposite respective vertically directed legs of the other foot tube on each side of the seat.

14. The bath chair of claim 13 in which the pairs of connecting tubes comprise two connecting tubes mounted on opposite undersides of the horizontal segment of each foot tube, each connecting tube having a cylindrical opening sized and disposed so that cylindrical openings of the connecting tubes mounted on the horizontal segment of one foot tube are aligned with and spaced from the cylindrical openings of the connecting tubes mounted on the horizontal segment of the other foot tube whereby opposed pairs thereof can receive respective horizontal segments of the backrest support tubes.

15. A bath chair, comprising:

a seat having top and bottom faces, a front, rear, and two sides, each side formed with an elongated slot;

two inverted U-shaped foot tubes, each having a horizontal segment between opposed vertically directed legs, the horizontal segments of the foot tubes being mounted crosswise to the bottom seat face whereby vertically directed legs of one foot tube are disposed opposite respective vertically directed legs of the other foot tube on each side of the seat;

a backrest;

two opposed L-shaped backrest support tubes, each having a vertically directed segment and a horizontal segment, the backrest being mounted across the two vertically directed segments;

two connecting tubes mounted on opposite undersides of the horizontal segment of each foot tube, spaced from respective elongated seat slots, each connecting tube having a cylindrical opening sized and disposed whereby cylindrical openings of the connecting tubes mounted on the horizontal segment of one foot tube are aligned with and spaced from the cylindrical openings of the connecting tubes mounted on the horizontal segment of the other foot tube whereby opposed pairs thereof can receive respective horizontal segments of the backrest support tubes; and a pair of handrails, each formed with a hand grip, vertically directed upper tubular segments connected at their upper ends to the hand grip, sigmoidal middle segments, and horizontally directed lower tubular segments, the lower segments secured to a cylindrical member of a length equal to or shorter than the distance between opposed pairs of connecting tubes and having an opening sized to receive a horizontal segment of one of the backrest support tubes, the lower segments of the each handrail being inserted through one of the elongated slots, the sigmoidal segments facilitating insertion through the respective elongated slot so that the cylindrical member is disposed between and aligned with opposed connecting tubes, the horizontal segment of one of the backrest support tubes being inserted through the opposed connecting tubes and the cylindrical member therebetween whereby to secure the handrail to the seat.

16. The bath chair of claim 15 in which each leg is formed with telescoping tubes with a plurality of position holes on the outer tube and a spring-loaded snap button on the inner tube for snap insertion into a position hole to secure the leg at a desired height.

17. The bath chair of claim 15 in which the horizontal segment of each backrest support tube has at least one spring loaded snap button, at least one of each respective pairs of connecting tubes having a position hole for the snap button to secure the backrest at a desired distance from the rear of the seat.

18. The bath chair of claim 17 in which the horizontal segment of each backrest support tube has a plurality of spring loaded snap buttons along its length to secure the backrest at one of a plurality of distances from the rear of the seat.

19. The bath chair of claim 15 in which the hand grip of each handrail is fixed to handrail's vertically directed segments.

20. The bath chair of claim 15 in which the hand grip is formed with vertically directed tubes in telescopic relation with the vertically directed upper tubular segments, the handrail having a plurality of position holes on the outer tube and a spring-loaded snap button on the inner tube for snap insertion into a position hole to secure the handrail at a desired height.

* * * * *